US008955841B2

(12) United States Patent
Endo

(10) Patent No.: US 8,955,841 B2
(45) Date of Patent: Feb. 17, 2015

(54) METHOD FOR CONTROLLING SHEET CONVEYANCE IN IMAGE FORMING APPARATUS

(71) Applicant: Canon Kabushiki Kaisha, Tokyo (JP)

(72) Inventor: Hiroto Endo, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 284 days.

(21) Appl. No.: 13/944,909

(22) Filed: Jul. 18, 2013

(65) Prior Publication Data

US 2014/0042693 A1 Feb. 13, 2014

(30) Foreign Application Priority Data

Aug. 7, 2012 (JP) ..... 2012-175411

(51) Int. Cl.

| | |
|---|---|
| ***B65H 5/34*** | (2006.01) |
| ***B65H 7/02*** | (2006.01) |
| ***G03G 15/00*** | (2006.01) |
| ***B65H 7/00*** | (2006.01) |
| ***B65H 7/08*** | (2006.01) |

(52) U.S. Cl.

CPC .. *B65H 7/02* (2013.01); *B65H 7/00* (2013.01); *G03G 2215/00721* (2013.01); *G03G 2215/00599* (2013.01); *B65H 7/08* (2013.01); *B65H 2511/22* (2013.01); *B65H 2513/21* (2013.01); *B65H 2513/22* (2013.01); *B65H 2701/1311* (2013.01); *B65H 2701/1313* (2013.01)

USPC ..... 271/270; 271/265.01; 399/396

(58) Field of Classification Search

CPC ..... B65H 2513/106; B65H 2513/511; B65H 7/00; B65H 5/34; B65H 2220/02; B65H 2215/00721; B65H 2215/00599; G03G 2215/00721; G03G 2215/00599; B56H 2220/02

USPC ..... 271/270, 265.01; 399/396

See application file for complete search history.

(56) References Cited

U.S. PATENT DOCUMENTS

| | | | | |
|---|---|---|---|---|
| 4,451,027 | A * | 5/1984 | Alper | 271/10.02 |
| 6,076,821 | A * | 6/2000 | Embry et al. | 271/10.01 |
| 6,519,443 | B1 * | 2/2003 | Coriale et al. | 399/388 |
| 6,533,264 | B1 * | 3/2003 | Tranquilla | 271/10.02 |
| 6,702,274 | B1 * | 3/2004 | Otsuka | 271/10.01 |
| 8,385,762 | B2 * | 2/2013 | Noguchi et al. | 399/66 |
| 8,590,891 | B2 * | 11/2013 | Takahashi et al. | 271/270 |
| 2003/0057639 | A1 * | 3/2003 | Chapman et al. | 271/270 |
| 2010/0148431 | A1 * | 6/2010 | Otsuka et al. | 271/265.01 |
| 2011/0064500 | A1 * | 3/2011 | Takahashi | 399/396 |
| 2011/0081181 | A1 * | 4/2011 | Saito | 399/395 |
| 2011/0175281 | A1 * | 7/2011 | Takahashi | 271/227 |
| 2012/0014731 | A1 * | 1/2012 | Yasui et al. | 399/396 |
| 2012/0027426 | A1 * | 2/2012 | Maruta | 399/16 |

FOREIGN PATENT DOCUMENTS

| | | | |
|---|---|---|---|
| JP | 5-289453 | A | 11/1993 |
| JP | 2000-281247 | A | 10/2000 |
| JP | 2000-335759 | A | 12/2000 |

* cited by examiner

*Primary Examiner* — Patrick Cicchino

(74) *Attorney, Agent, or Firm* — Fitzpatrick, Cella, Harper & Scinto

(57) ABSTRACT

An actual sheet interval from a preceding sheet to a succeeding sheet is detected by a top sensor. A registration roller is accelerated or decelerated such that the sheet interval from the preceding sheet to the succeeding sheet is an ideal value by the time that the leading edge of the succeeding sheet reaches a transfer nip part. Note that a time period during which acceleration or deceleration is applied and a sub-scan synchronization signal output timing are determined from the actual sheet interval. Note that a recording sheet P does not stop at the registration roller.

26 Claims, 10 Drawing Sheets

METHOD FOR CONTROLLING SHEET CONVEYANCE IN IMAGE FORMING APPARATUS

BACKGROUND OF THE INVENTION

1. Field of the Invention

The present invention relates to an image forming apparatus that forms an image using toner on a sheet by an electrophotographic method, an electrostatic recording method, a magnetic recording method, or the like.

2. Description of the Related Art

Recently, there is a tendency that the process speed of image formation on a sheet is lowered to reduce noise generated by an image forming apparatus, while a sheet interval is narrowed to achieve conventional throughput. "Sheet interval" refers to the distance from the trailing edge of a preceding sheet to the leading edge of a succeeding sheet when an image is formed successively on a plurality of sheets. However, if the sheet interval is narrowed, erroneous double feed detection and conveyance error are more likely to occur when sheet feed time varies.

Japanese Patent Laid-Open No. 2000-335759 proposes avoidance of double feed of preceding and succeeding sheets by delaying the timing of feeding the succeeding sheet when feed of the preceding sheet is delayed. Japanese Patent Laid-Open No. 5-289453 recites that after a lapse of predetermined period after detection of the leading edge of a sheet by a registration sensor, conveyance of the sheet is temporarily stopped in a state where the leading edge of the sheet is caused to abut a timing roller, and thereafter, the sheet conveyance speed is accelerated. Japanese Patent Laid-Open No. 2000-281247 proposes that a sheet is detected by a sensor arranged upstream of a transfer nip part, and the leading edge positions of the sheet are uniformly aligned without stopping the sheet at a registration roller position.

With the invention of Japanese Patent Laid-Open No. 2000-335759, variation in sheet feeding cannot be disregarded if the sheet interval is narrowed, often resulting in difficulty in achievement of throughput. With the invention of Japanese Patent Laid-Open No. 5-289453, a sheet is temporarily stopped at the registration roller position to make the sheet intervals uniform. However, since the amount of flexure (loop) of a sheet that occurs when the sheet is stopped varies depending on the leading edge position of the sheet, the accuracy of the image formation position on the sheet is likely to decrease. With the invention recited in Japanese Patent Laid-Open No. 2000-281247, a sheet is conveyed at a uniform speed from the registration roller position to the transfer nip part. That is to say, the sheet has to be accelerated to maintain a fixed sheet interval, before the sheet reaches the registration roller position. This requires provision of an acceleration section by extending a conveyance section from a sheet cassette to the registration roller, which leads to an increase in the size of the image forming apparatus.

SUMMARY OF THE INVENTION

In light of this, a feature of the present invention is to suppress an increase in the size of an image forming apparatus, while achieving high throughput and increasing the accuracy of the image formation position.

The present invention provides an image forming apparatus comprising the following elements. An image bearing member on which an image is formed. A transfer unit is configured to transfer an image formed on the image bearing member onto a sheet. A conveyance unit is configured to successively convey a first sheet and a second sheet toward the transfer unit. A detection unit is configured to detect a sheet at a predetermined position on an upstream side of the transfer unit in a sheet conveyance direction. An image forming unit is configured to start formation of an image on the image bearing member after a predetermined period from detection of a sheet by the detection unit. If the detection unit detects a leading edge of the second sheet at a predetermined timing after detecting a trailing edge of the first sheet, the conveyance unit conveys the second sheet at a first conveyance speed, which is a conveyance speed at the time when an image is transferred onto a sheet. If the detection unit detects the leading edge of the second sheet at a timing later than the predetermined timing after detecting the trailing edge of the first sheet, the conveyance unit switches the conveyance speed to a second conveyance speed, which is higher than the first conveyance speed, and conveys the second sheet at the second conveyance speed. The predetermined period in the case where the conveyance unit conveys the second sheet at the second conveyance speed is shorter than the predetermined period in the case where the conveyance unit conveys the second sheet at the first conveyance speed.

Further features of the present invention will become apparent from the following description of exemplary embodiments (with reference to the attached drawings).

BRIEF DESCRIPTION OF THE DRAWINGS

FIG. 9A is a diagram showing a method for finding T2a.

DESCRIPTION OF THE EMBODIMENTS

Figure 1:
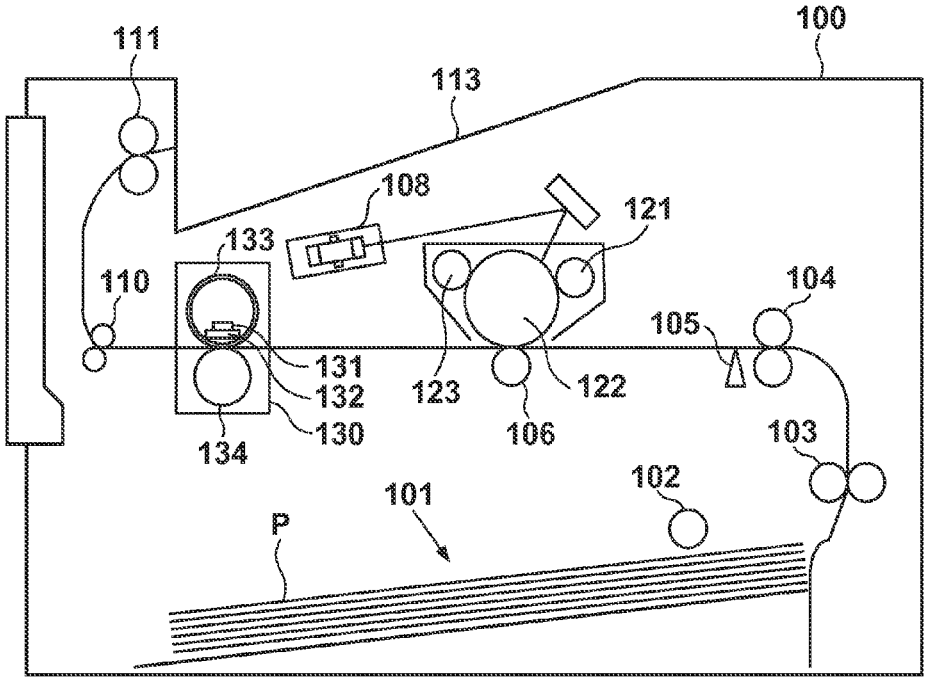
FIG. 1 is a cross-sectional view showing an exemplary image forming apparatus.

In FIG. 1, an image forming apparatus 100 is an electrophotographic printer. A photosensitive drum 122 is an image bearing member that is made of, for example, an organic photosensitive member or an amorphous silicon photosensitive member, and rotates clockwise at a predetermined circumferential speed (process speed) Vd. A charging roller 123 charges the peripheral surface of the photosensitive drum 122 at a uniform potential. A laser optical unit 108 irradiates the peripheral surface of the photosensitive drum 122 with laser light modulated according to image information that is input from an image signal generator such as an image reading device or a computer. Thus, an electrostatic latent image corresponding to the image information is formed. The timing of starting exposure in a sub-scan direction is determined by a sub-scan synchronization signal. In other words, the laser optical unit 108 functions as an image forming unit that forms an image on the image bearing member at the timing of the synchronization signal. A development roller 121 develops the electrostatic latent image using toner and forms a toner image.

A sheet feed roller 102 feeds sheets P one by one from a sheet cassette 101 to a conveyance path. The sheet cassette 101, a manual bypass tray, and the like function as an accommodation unit that accommodates the sheets and supplies them to the conveyance path. A conveyance roller 103 and a registration roller 104 convey the sheet P further downstream. The conveyance roller 103 and the registration roller 104 are examples of a plurality of conveyance units that convey the sheet P from the sheet cassette 101 to a transfer roller 106. The registration roller 104 is a conveyance unit that is arranged closest to the transfer roller 106, among the conveyance units. In a conveyance section from the registration roller 104 to the transfer roller 106, a top sensor 105, which serves as a detection unit for detecting the sheet P, is arranged. The top sensor 105 is arranged on the upstream side of the transfer roller 106 in the sheet conveyance direction. The conveyance roller 103 and the registration roller 104 are arranged on the upstream side of the transfer roller 106 in the sheet conveyance direction. A toner image is transferred onto the sheet P from the photosensitive drum 122 when the sheet P passes through a transfer nip part formed by the photosensitive drum 122 and the transfer roller 106. The transfer roller 106, a transfer blade, and the like function as a transfer unit that transfers an image that is formed on the image bearing member onto the sheet. A heat-fixing unit 130 includes a thermistor 131, a heater 132, a fixing film 133, and a pressure roller 134. The heat-fixing unit 130 maintains a constant temperature of the heater 132 in accordance with the temperature detected by the thermistor 131. The toner image is fixed on the sheet P by the fixing film 133 and the pressure roller 134. The sheet P is conveyed by an FU roller 110 and an FD roller 111, and discharged to an FD tray 113.

Figure 2:
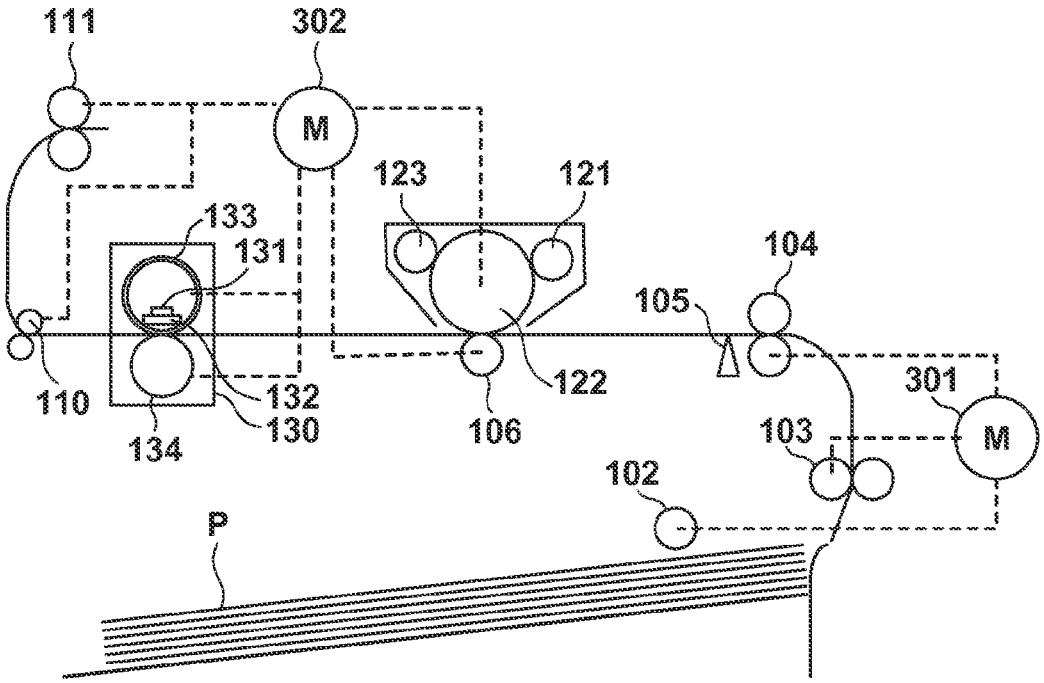
FIG. 2 is a diagram showing a drive relationship between rollers and motors.

FIG. 2 is a diagram showing a relationship between rollers and motors for driving the rollers in the image forming apparatus 100. The image forming apparatus 100 uses a conveyance motor 301 and a fixing motor 302. The conveyance motor 301 drives the sheet feed roller 102, the conveyance roller 103, and the registration roller 104. The conveyance motor 301 functions as a drive unit that drives the plurality of conveyance units. The fixing motor 302 drives the photosensitive drum 122, the transfer roller 106, the pressure roller 134, the FU roller 110, and the FD roller 111. The conveyance motor 301 is a stepping motor.

Figure 3:
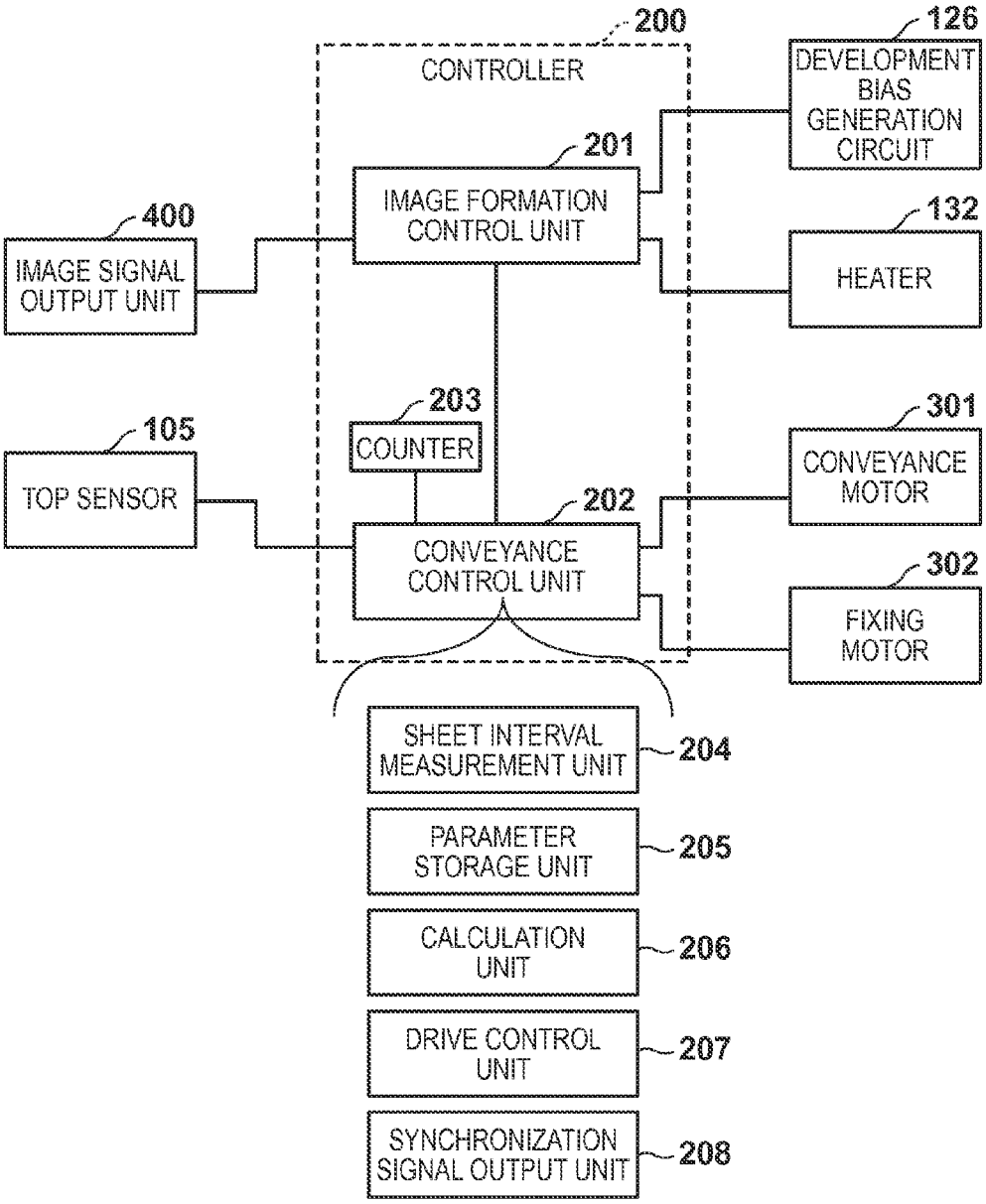
FIG. 3 is a block diagram showing an exemplary control system.

In FIG. 3, a controller 200 has an image formation control unit 201 and a conveyance control unit 202. The controller 200 is constituted by a microprocessor that comprehensively controls the overall image forming apparatus 100, a ROM that stores control programs, a RAM that stores data and the like, a gate array, and the like.

The image formation control unit 201 controls a development bias generation circuit 126, a heater 132, and an image signal output unit 400 to form an image on the sheet P and fix it with heat. The development bias generation circuit 126 generates development bias that is applied to the development roller. The image signal output unit 400 outputs an image signal to the laser optical unit 108 at the timing of the sub-scan synchronization signal output by the image formation control unit 201. The sub-scan synchronization signal is generated by the conveyance control unit 202 and output to the image signal output unit 400 by way of the image formation control unit 201. The laser optical unit 108 performs control for turning on/off a laser beam in accordance with the image signal.

The conveyance control unit 202 monitors a detection signal of the top sensor 105, determines the timing of outputting the sub-scan synchronization signal, and controls drive of the conveyance motor 301 and the fixing motor 302. The detection signal of the top sensor 105 indicates whether or not a sheet P is passing through, that is, the presence of a sheet. When a detection signal indicating "no sheet" changes to a detection signal indicating "a sheet is present", the conveyance control unit 202 recognizes that the leading edge of the sheet P has arrived. Also, when the detection signal indicating "a sheet is present" changes to the detection signal indicating "no sheet", the conveyance control unit 202 recognizes that the trailing edge of the sheet P has passed through. A sheet interval measurement unit 204 measures an actual sheet interval, which is a conveyance interval from the trailing edge of a preceding sheet P1 to the leading edge of a succeeding sheet P2, using the detection signal from the top sensor 105 and a counter 203. The sheet interval measurement unit 204 functions as a measurement unit that measures the sheet interval using the top sensor 105. A parameter storage unit 205 stores parameters used by a calculation unit 206 for calculation, data of the conveyance speed used by the drive control unit 207, and the like. The parameters include, for example, the conveyance speed that is defined by the performance of the conveyance motor 301, an acceleration period Taa that is necessary for increasing the conveyance speed from Vp1 to Vp2, a deceleration period Tda that is necessary for decreasing the conveyance speed from Vp2 to Vp1, and the like. The calculation unit 206 executes various calculations based on various expressions, which will be described later. The drive control unit 207 controls the conveyance motor 301 and the fixing motor 302 in accordance with the timings and the conveyance speed that are determined by the calculation unit 206. For example, the drive control unit 207 can change the number of rotations of the conveyance motor 301 by changing a clock cycle. Note that the drive control unit 207 reduces variation in the leading edge position caused by the stopping of the sheet P, by controlling the conveyance motor 301 such that the sheet P passes through the registration roller 104 without stopping. Further, the drive control unit 207 accelerates or decelerates the conveyance speed of the succeeding sheet P2 in a section from the top sensor 105 to the transfer roller 106 in accordance with a difference between an actual sheet interval Lac and a predetermined ideal/proper value Lid of the sheet interval. Thus, the drive control unit 207 functions as a drive control unit that brings, close to the ideal value Lid, the sheet interval from the leading edge of the succeeding sheet P2 to the trailing edge of the preceding sheet P1 when the leading edge of the succeeding sheet P2 reaches the transfer roller. A synchronization signal output unit 208 outputs the sub-scan synchronization signal to the image formation control unit 201 when a predetermined period has elapsed since the timing when the top sensor 105 detects the leading edge of the sheet P. As a result of laser light emission being started simultaneously with the output of the sub-scan synchronization signal, an image is formed on the photosensitive drum 122 such that the image is transferred, starting from the O-mm position of the leading edge of the sheet P. Furthermore, the synchronization signal output unit 208 functions as a synchronization signal output unit that adjusts an image transfer position on the succeeding sheet P2 by outputting the sub-scan synchronization signal at the timing determined in accordance with the difference (Ln or Lw) between the actual sheet interval Lac measured by the sheet interval measurement unit 204 and the ideal value Lid. In other words, the synchronization signal output unit 208 functions as a synchronization signal output unit that outputs the synchronization signal for determining the timing of forming an image on the image bearing member.

Figure 4:
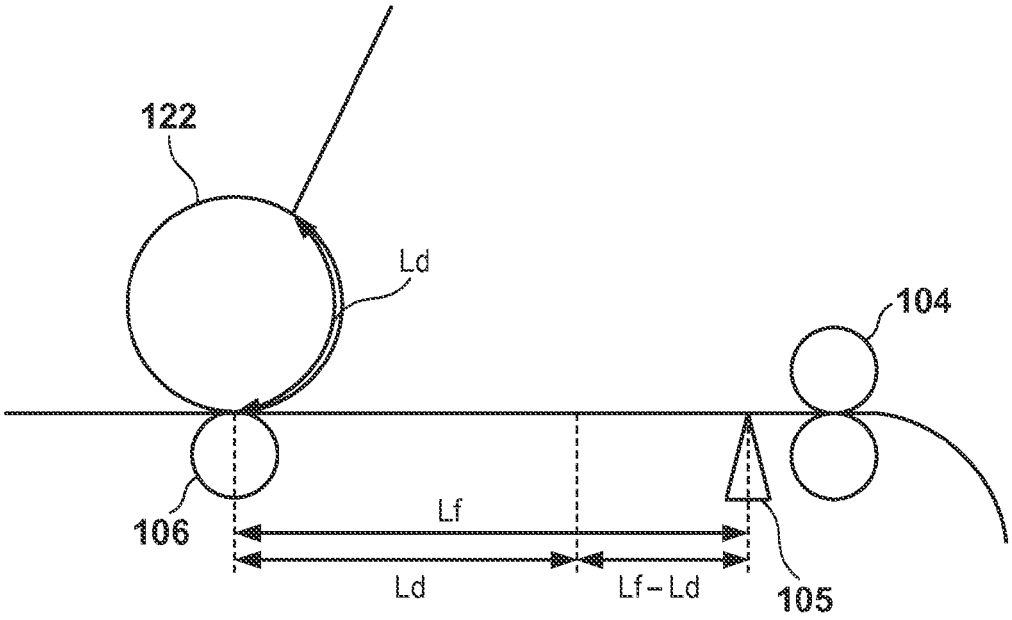
FIG. 4 is a diagram showing the distance between units.

A time period Ttop from when the leading edge of the sheet P is detected by the top sensor 105 until when the sub-scan synchronization signal is output will be described, referring to FIG. 4. It is assumed that the sheet P is conveyed at a constant conveyance speed Vp1. As shown in FIG. 4, Ld is a creepage distance from a laser irradiation position on the photosensitive drum 122 to the transfer nip part. Lf is the distance from the top sensor 105 to the transfer nip part. The constant conveyance speed Vp1 of the sheet P coincides with the circumferential speed Vd of the photosensitive drum 122. Accordingly, image formation on the photosensitive drum 122 should be started when the sheet P has advanced from the top sensor 105 by Lf−Ld. That is to say, the time period Ttop from the timing t1 when the leading edge of the sheet P is detected by the top sensor 105 to the timing t3 when image formation on the photosensitive drum 122 is started can be expressed by Eq. 1.

$$T\text{top}=(Lf-Ld)/Vd \quad \text{Eq. 1}$$

Here, it is assumed that the top sensor 105 is arranged such that Lf is longer than Ld.

Figure 5:
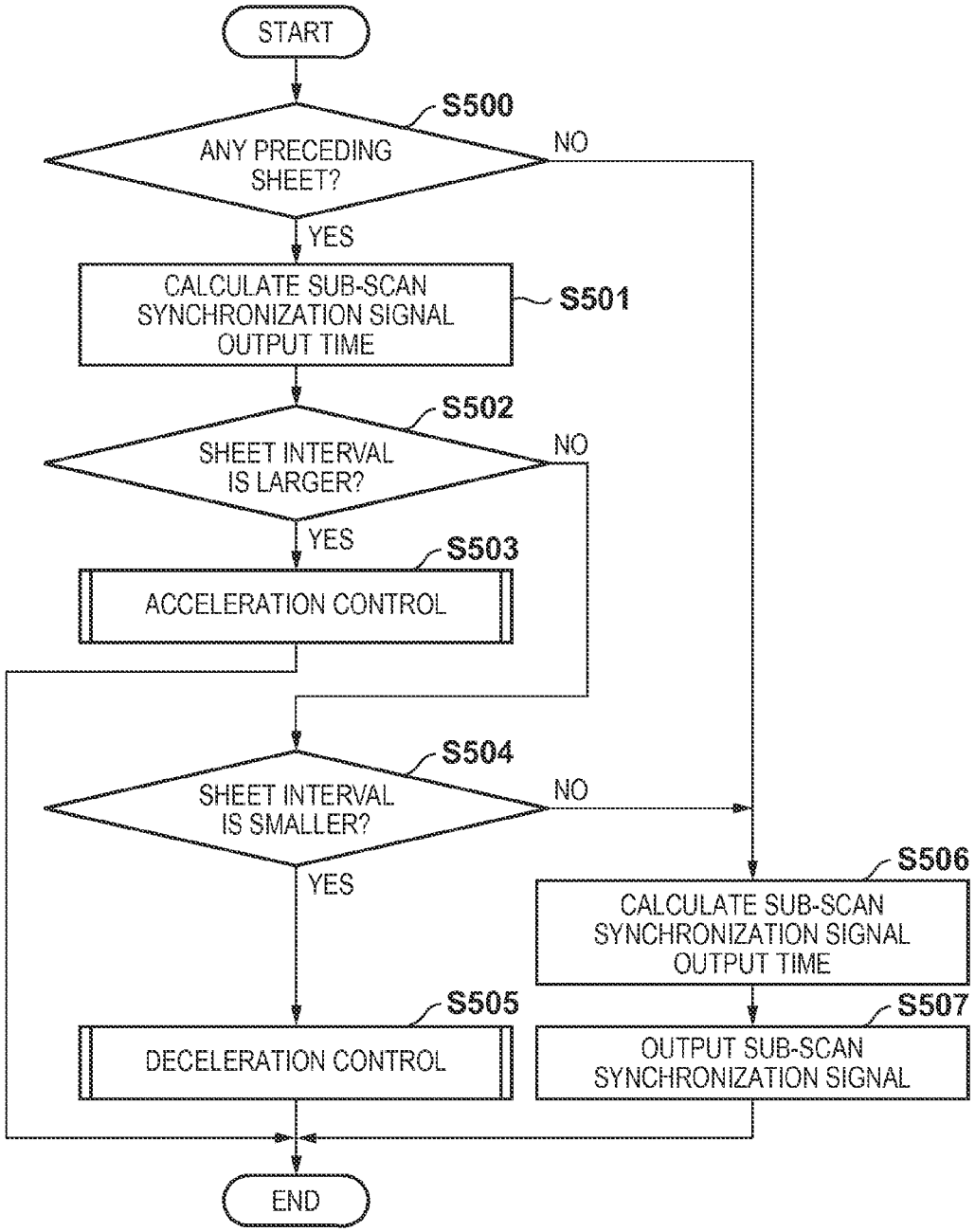
FIG. 5 is a flowchart showing sheet conveyance control.

The flowchart of FIG. 5 shows processing executed by the controller 200 in accordance with a control program. Upon the top sensor 105 detecting the leading edge of a sheet P, processing proceeds to step S500. In step S500, the conveyance control unit 202 in the controller 200 checks whether or not there is a preceding sheet that has been conveyed prior to the sheet P. For example, the sheet control unit 202 may analyze information on an image formation job and determine whether the sheet P detected by the top sensor 105 is the first sheet of the image formation job or the second or subsequent sheet. In other words, if the sheet P detected by the top sensor 105 is the first sheet of the image formation job, it can be determined that there is no preceding sheet. If the sheet P detected by the top sensor 105 is the second or subsequent sheet of the image formation job, it can be determined that there is a preceding sheet. Also, the conveyance control unit 202 includes the counter 203 for measuring the sheet interval from the preceding sheet P1 to the succeeding sheet P2. The sheet interval measurement unit 204 in the conveyance control unit 202 may find the sheet interval Lac from the preceding sheet P1 to the succeeding sheet P2 using a count value of the counter 203, and it may be deemed that there is no preceding sheet if the found sheet interval is larger than Lf.

If there is no preceding sheet, the conveyance motor 301 is not accelerated or decelerated, and accordingly, processing proceeds to step S506. In step S506, the calculation unit 206 calculates the time period Ttop that determines the sub-scan synchronization signal output timing, using Eq. 1. In step S507, the synchronization signal output unit 208 outputs the sub-scan synchronization signal after the fixed time period Ttop from the timing t1 when the top sensor 105 detects the leading edge of the sheet P.

On the other hand, if the conveyance control unit 202 determines that there is a preceding sheet, processing proceeds to step S501. In step S501, the sheet interval measurement unit 204 in the conveyance control unit 202 measures the actual sheet interval Lac from the trailing edge of the preceding sheet P1 to the leading edge of the succeeding sheet P2, using the counter 203. The calculation unit 206 in the conveyance control unit 202 calculates the sheet interval Lac by multiplying, by the conveyance speed Vp1, a time period (sheet interval period tac) from the timing when the trailing edge of the preceding sheet P1 is detected by the top sensor 105 to the timing when the leading edge of the succeeding sheet P2 is detected. Note that in practice, the sheet interval may be handled as time, rather than converting it into distance, or the count value of the counter 203 may be handled as is. However, in this description, the sheet interval is converted into distance to make it easy to understand the technical idea.

In step S502, the conveyance control unit 202 determines whether or not the actual sheet interval Lac, which is the distance from the trailing edge of the preceding sheet P1 to the leading edge of the succeeding sheet P2, is larger than the ideal value Lid. Logical operations such as determination processing may also be performed by the calculation unit 206. The sheet interval measurement unit 204 in the conveyance control unit 202 counts, with the counter 203, the time period from the timing when the top sensor 105 detects the trailing edge of the preceding sheet P1 to the timing when it detects the leading edge of the succeeding sheet P2. The sheet interval measurement unit 204 in the conveyance control unit 202 acquires the count value of the counter 203 and finds the actual sheet interval Lac from the count value. The calculation unit 206 compares the actual sheet interval Lac with the ideal value Lid.

Figure 6A:
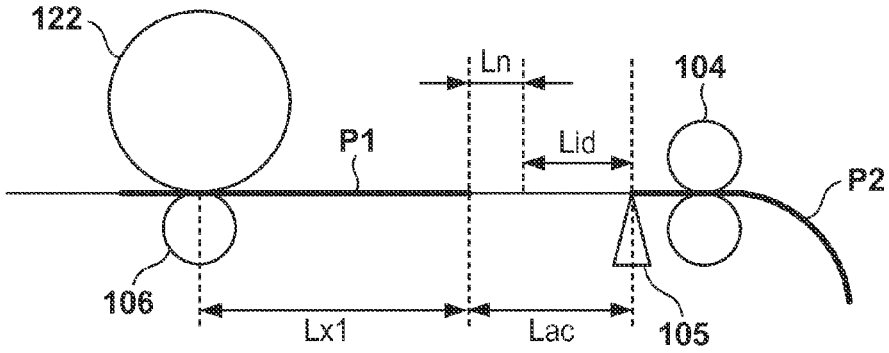
FIG. 6A is a diagram showing a case where a sheet interval should be shortened.

FIG. 6A shows the case where the actual sheet interval Lac is larger than the ideal value Lid by the distance Ln when the top sensor 105 detects the leading edge of the succeeding sheet P2. In this case, the sheet interval from the succeeding sheet P2 to the preceding sheet P1 needs to be shortened by the distance Ln by the time that the leading edge of the succeeding sheet P2 reaches the transfer nip part. Note that the distance from the trailing edge of the preceding sheet P1 to the transfer nip part is Lx1. The distance from the top sensor 105 to the trailing edge of the preceding sheet P1 is Lac.

Figure 6B:
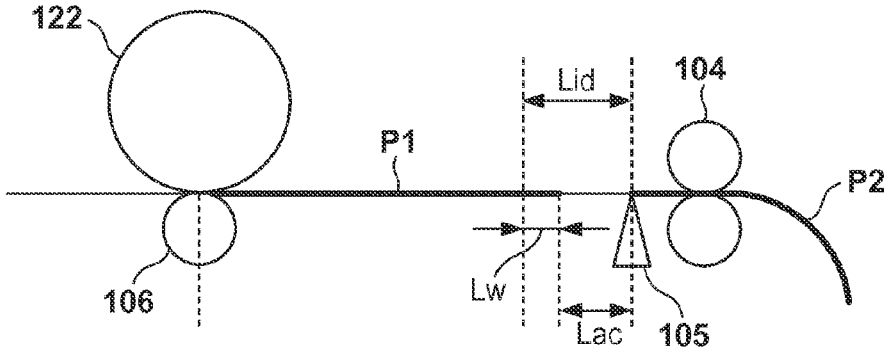
FIG. 6B is a diagram showing a case where a sheet interval should be extended.

FIG. 6B shows the case where the actual sheet interval Lac is smaller than the ideal value Lid by the distance Lw when the top sensor 105 detects the leading edge of the succeeding sheet P2. In this case, the sheet interval from the succeeding sheet P2 to the preceding sheet P1 needs to be extended by the distance Lw by the time that the leading edge of the succeeding sheet P2 reaches the transfer nip part.

Figure 6C:
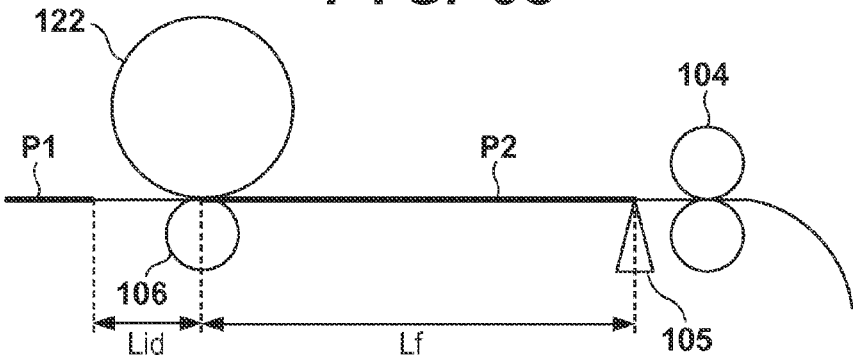
FIG. 6C is a diagram showing a case where a sheet interval has been adjusted so as to be an ideal/proper value.

FIG. 6C indicates that the sheet interval has been corrected to the ideal value Lid when the leading edge of the succeeding sheet P2 reaches the transfer nip part. The drive control unit 207 performs control such that the sheet interval is the ideal value Lid by accelerating or decelerating the conveyance speed of the succeeding sheet P2 during the time period from the timing when the top sensor 105 detects the leading edge of the succeeding sheet P2 to the timing when the leading edge of the succeeding sheet P2 reaches the transfer nip part.

If the actual sheet interval Lac measured by the sheet interval measurement unit 204 is larger than the ideal value Lid as shown in FIG. 6A, processing proceeds to step S503. In step S503, the drive control unit 207 in the conveyance control unit 202 accelerates the conveyance speed of the succeeding sheet P2. If the actual sheet interval Lac is not larger than the ideal value Lid, processing proceeds to step S504.

In step S504, the calculation unit 206 in the conveyance control unit 202 determines whether or not the actual sheet interval Lac is smaller than the ideal value Lid. If the actual sheet interval Lac is not larger or smaller than the ideal value Lid, the sheet interval Lac coincides with the ideal value Lid. In other words, there is no need to perform acceleration control or deceleration control for the succeeding sheet P2, and accordingly, processing proceeds to step S506. On the other hand, if the actual sheet interval Lac is smaller than the ideal value Lid, processing proceeds to step S505.

In step S505, the drive control unit 207 in the conveyance control unit 202 executes the deceleration control for the succeeding sheet P2 and extends the sheet interval by the distance Lw.

Details of Acceleration Control

Figure 7:
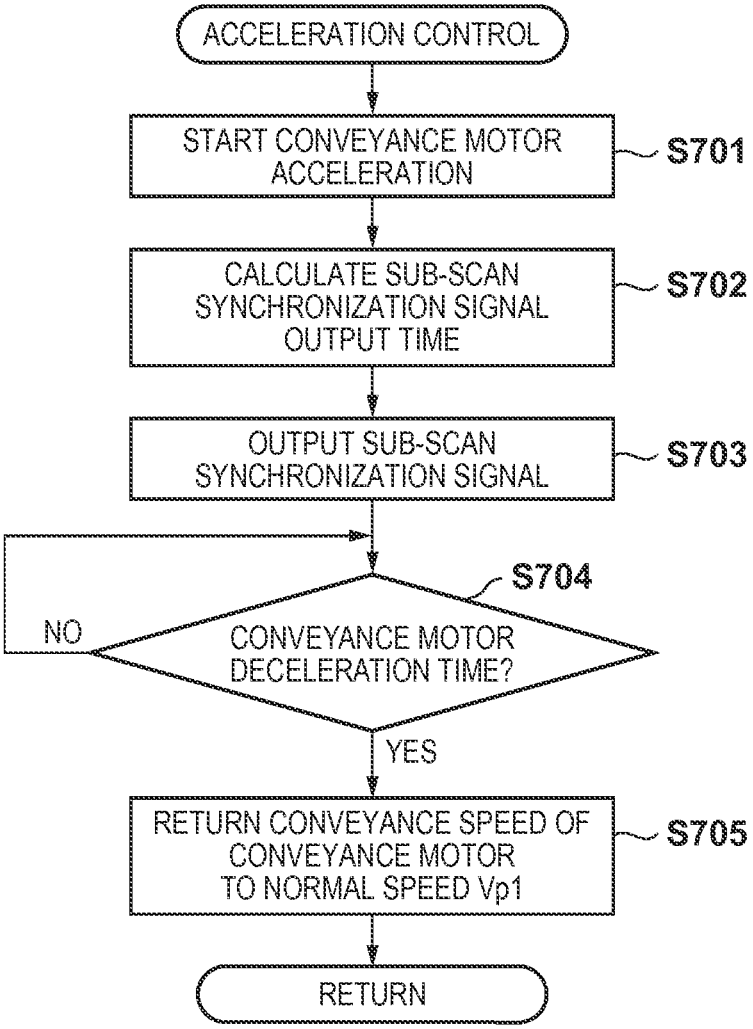
FIG. 7 is a flowchart showing acceleration control.

The acceleration control executed by the conveyance control unit 202 will be described, referring to FIG. 7. In step S701, the drive control unit 207 in the conveyance control unit 202 controls the conveyance motor 301 and accelerates the conveyance speed of the succeeding sheet P2 from Vp1 to Vp2. Vp1 coincides with the circumferential speed Vd of the photosensitive drum 122, and Vp2 is a higher speed than the circumferential speed Vd. Note that the speed Vp2 may be a predetermined constant speed, or may be a speed that is dynamically adjusted such that the shortening of the sheet interval can be finished by the time that the succeeding sheet P2 reaches the transfer nip part.

In step S702, the conveyance control unit 202 calculates a timing Ttop2 of outputting the sub-scan synchronization signal from the distance Ln by which the sheet interval should be shortened by the time that the leading edge of the succeeding sheet P2 reaches the transfer nip part. The output timing Ttop2 can be calculated from Eq. 2.

$$T\text{top2}=(Lf-Ld-Ln)/Vd \quad \text{Eq. 2}$$

As shown in FIG. 6A, the difference between the actual sheet interval Lac and the ideal value Lid is the distance Ln by which the sheet interval should be shortened. Accordingly, the calculation unit 206 calculates the distance Ln by subtracting the ideal value Lid from the actual sheet interval Lac, and calculates the output timing Ttop2 using the distance Ln.

In step S703, the synchronization signal output unit 208 in the conveyance control unit 202 outputs the sub-scan synchronization signal to the image formation control unit 201 at the timing t3 when Ttop2, which begins at the timing t1 when the top sensor 105 detects the leading edge of the succeeding sheet P2, has elapsed.

Figure 8A:
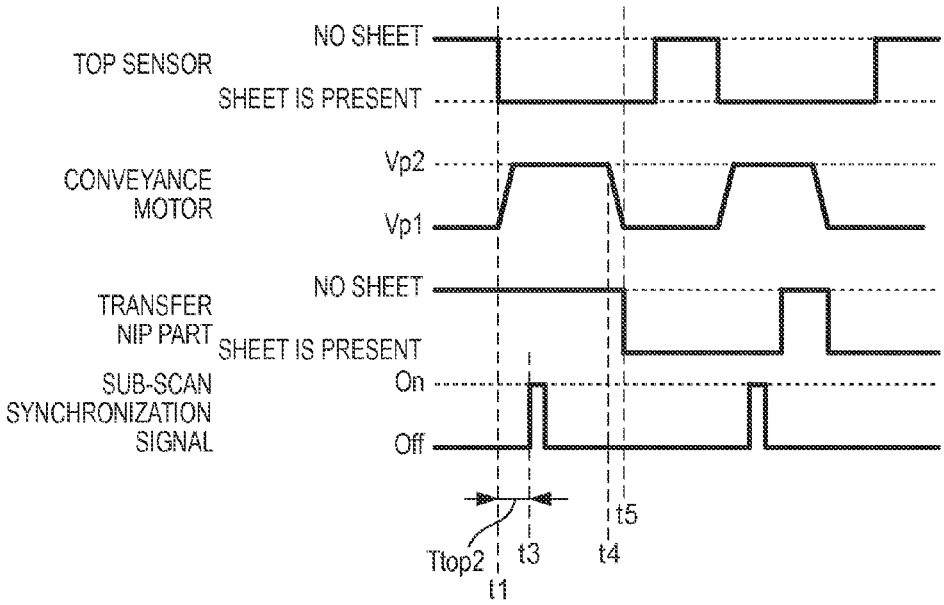
FIG. 8A is a diagram showing signal timings.

FIG. 8A indicates a relationship between the detection signal of the top sensor 105, the conveyance speed of the conveyance motor, the presence of a sheet at the transfer nip part, and the sub-scan synchronization signal. Upon the top sensor 105 detecting the leading edge of the succeeding sheet P2 at the timing t1, the drive control unit 207 in the conveyance control unit 202 starts to accelerate the conveyance motor. At the timing t3 when Ttop2 has elapsed since the timing t1, the synchronization signal output unit 208 outputs the sub-scan synchronization signal to the image formation control unit 201.

In step S704, the drive control unit 207 in the conveyance control unit 202 determines whether or not a timing t4 of decelerating the conveyance motor 301 has been reached. The drive control unit 207 measures and manages the timings using the counter 203. Accordingly, the drive control unit 207 acquires the count value of the counter 203 and determines whether or not the count value coincides with the deceleration timing t4. Note that the deceleration timing t4 is managed based on the elapsed time from the timing t1 when the top sensor 105 detects the leading edge of the succeeding sheet P2. Note that these timings may be managed by the calculation unit 206.

In step S705, the drive control unit 207 decelerates the conveyance speed of the conveyance motor 301 from Vp2 to Vp1. The conveyance speed of the succeeding sheet P2 at the registration roller 104 thus coincides with the conveyance speed at the photosensitive drum 122.

Figure 9A:
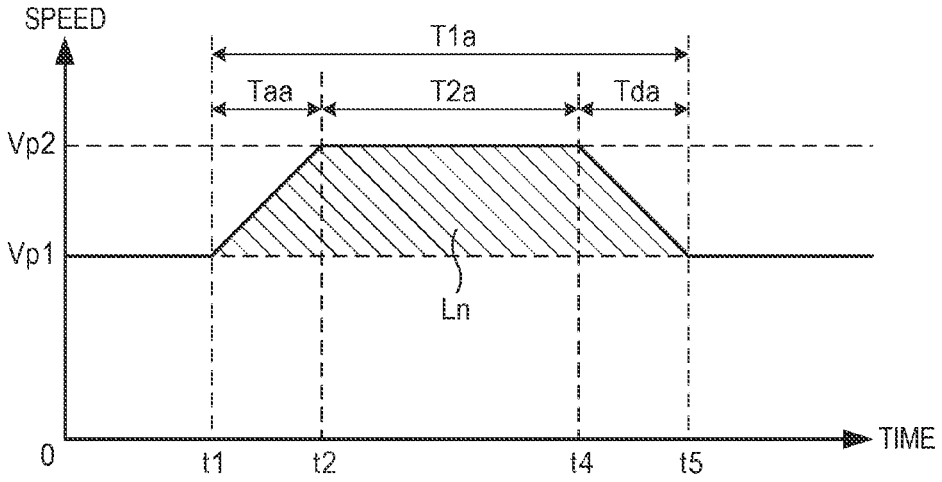

A method for determining the deceleration timing t4 will be described, referring to FIG. 9A. The method for determining the deceleration timing t4 is substantially nothing other than determination of a timing T2a. FIG. 9A shows a change of the conveyance speed of the sheet P at the registration roller 104. Taa is a time period required to accelerate the conveyance motor 301. Tda is a time period required to decelerate the conveyance motor 301. T2a is a time period of maintaining the speed Vp2. T1a is a time period after the timing t1 when the leading edge of the succeeding sheet P2 is detected by the top sensor 105 to a timing t5 when it reaches the transfer nip part.

As shown in FIG. 6C, the distance (sheet interval) from the leading edge of the succeeding sheet P2 to the trailing edge of the preceding sheet P1 is required to be the ideal value Lid at the timing t5 when the leading edge of the succeeding sheet P2 reaches the transfer nip part. To realize this, as shown in FIGS. 6A and 6C, the leading edge of the succeeding sheet P2 need only advance by the distance Lf (=Lx1+Lid+Ln) while the trailing edge of the preceding sheet P1 advances by the distance (Lx1+Lid). In other words, the succeeding sheet P2 need only advance further than the preceding sheet P1 by the distance Ln during the time period T1a shown in FIG. 9A. Here, since the preceding sheet P1 advances at the speed Vp1 by the distance (Lx1+Lid) during the time period T1a, the following expression holds.

$$Vp1\cdot T1a=Lx1+Lid \quad \text{Eq. 3}$$

As shown in FIG. 6A, Lx1+Lid=Lf−Ln. Eq. 4 is obtained by transforming Eq. 3 with this relationship.

$$T1a=(Lf-Ln)/Vp1 \quad \text{Eq. 4}$$

Note that at the timing t1 when the leading edge of the succeeding sheet P2 reaches the top sensor 105, the preceding sheet P1 is already held by the transfer nip part. Accordingly, the preceding sheet P1 is being conveyed at the conveyance speed Vp1 that is the same as the circumferential speed Vd of the photosensitive drum. From FIG. 6A, the following expression holds.

$$Ln=Lac-Lid \quad \text{Eq. 5}$$

Eq. 6 is obtained by substituting Eq. 5 into Eq. 2.

$$T\text{top2}=(Lf-Ld-Lac+Lid)/Vd \quad \text{Eq. 6}$$

As mentioned above, Lac is the distance by which the trailing edge of the preceding sheet P1 advances after passing through the top sensor 105 until the leading edge of the succeeding sheet P2 reaches the top sensor 105. The time period tac after the trailing edge of the preceding sheet P1 passes through the top sensor 105 until the leading edge of the succeeding sheet P2 reaches the top sensor 105 can be measured using the counter 203. Since the preceding sheet P1 is being held by the transfer nip part, the conveyance speed of the preceding sheet P1 is Vp1 (=Vd), and the following expression is obtained.

$$Lac=tac\cdot Vd \quad \text{Eq. 7}$$

Eq. 8 is obtained by substituting Eq. 7 into Eq. 6 and arranging it.

$$T\text{top2}=c0-tac \quad \text{Eq. 8}$$

Here, c0 is (Lf−Ld+Lid)/Vd and is a known constant. Accordingly, Ttop2 can be easily found from the constant c0 and the sheet interval period tac found from the count value of the counter 203 (S702).

Meanwhile, in FIG. 9A, T1a is a time period from the timing t1 when the leading edge of the succeeding sheet P2 reaches the top sensor 105 to the timing t5 when the leading edge of the succeeding sheet P2 reaches the transfer nip part. By accelerating the conveyance speed Vp1 to Vp2 during the time period from the timing t1 to the timing t5, the succeeding sheet P2 can advance further than the preceding sheet P1 by the distance Ln. In FIG. 9A, the horizontal axis indicates time, and the vertical axis indicates the conveyance speed. Accordingly, the area of each region shown in FIG. 9A represents a distance. Therefore, T2a results in a solution according to which the area of the hatched region shown in FIG. 9A is the distance Ln. When the distance Ln is generalized, the following expression is obtained.

$$Ln=\int_{t1}^{t2}v1(t)dt+\int_{t2}^{t4}v2(t)dt+\int_{t4}^{t5}v3(t)dt-(Lx1+Lid) \quad \text{Eq. 9}$$

Here, v1(t) is the conveyance speed of the succeeding sheet P2 in the section from the timing t1 to the timing t2. v2(t) is the conveyance speed of the succeeding sheet P2 in the section from the timing t2 to the timing t4. v3(t) is the conveyance speed of the succeeding sheet P2 in the section from the timing t4 to the timing t5. Since v1(t) and v3(t) depend on properties of the conveyance motor 301, they are expressed not only by linear functions but also by higher-order functions such as quadratic functions in some cases. Also, v1(t) and v3(t) may be discrete functions. v1(t) and v3(t) may be, for example, variable and discrete values from 1.0 times to 1.5 times of Vp1. Note that Vp2 may be, but does not necessarily have to be, the highest speed, which is the performance limit of the conveyance motor 301. The sheet interval can be brought close to the ideal value Lid in a short time by setting Vp2 to the highest speed, which is the performance limit of the conveyance motor 301. However, it also causes the maximum driving sound of the conveyance motor 301. To reduce the driving sound, the sheet interval need only be brought close to the ideal value Lid by making the best of the section from the position of the top sensor 105 to the position of the transfer nip part (i.e., the section Lf in terms of distance, and the time period T1a in terms of time). In other words, the driving sound can be minimized by selecting the speed Vp2, which is the lower limit at which the sheet interval can be shortened by the distance Ln, during T1a. That is to say, the speed Vp2 need only be set within the acceptable range of driving sound. The driving sound and the speed of the conveyance motor 301 are in a trade-off relationship.

Here, for the sake of convenience of description, it is assumed that both the acceleration rate from Vp1 to Vp2 and the acceleration rate from Vp2 to Vp1 are constant. The area of the hatched portion of FIG. 9A, that is, the distance Ln is calculated from the following expression.

$$Ln=(T1a+T2a)\cdot(Vp2-Vp1)/2 \quad \text{Eq. 10}$$

T2a is found by transforming this, and then, the following expression is obtained.

$$T2a=2Ln/(Vp2-Vp1)-T1a \quad \text{Eq. 11}$$

Here, the following expression is obtained by substituting Eq. 4 into Eq. 11.

$$T2a=2Ln/(Vp2-Vp1)-(Lf-Ln)/Vp1 \quad \text{Eq. 12}$$

Note that Vp1, Vp2 and Lf are known. Also, Eq. 13 holds from FIG. 6A.

$$Ln=Lac-Lid \quad \text{Eq. 13}$$

Eq. 14 is obtained by substituting Eq. 7 into Eq. 13 and arranging it.

$$Ln=Vp1\cdot tac-Lid \quad \text{Eq. 14}$$

Thereby, Ln is defined from Eq. 14 by measuring the sheet interval period tac. In other words, if the sheet interval period tac can be measured, T2a can be calculated from Eq. 12. Note that Eq. 12 can be expressed as follows using two coefficients α and β that can be found in advance.

$$T2a=\alpha\cdot tac+\beta \quad \text{Eq. 12'}$$

Note that α is determined from Vp1 and Vp2, and β is determined from Vp1, Vp2, Lid, and Lf. Since the process of transforming Eq. 12 into Eq. 12' is redundant, it is omitted here.

Incidentally, if the ideal value Lid of the sheet interval is set to the minimum resolution of the top sensor 105, high throughput can be realized. "Throughput" refers to the number of sheets on which an image can be formed per unit time. "Minimum resolution" refers to the minimum interval (e.g., about 15 mm) between two successive sheets that can be detected by the top sensor 105. In other words, the minimum value of the sheet interval depends on the performance of the top sensor 105.

T2a corresponds to the time period during which processing stays at step S704. Accordingly, the conveyance control unit 202 can determine whether or not the current time is the deceleration timing t4 by determining whether or not T2a has elapsed since the timing t2 when acceleration of the conveyance motor 301 ended. Note that if the conveyance motor 301 is a pulse motor, the conveyance control unit 202 may manage T2a, which is a time period of rotation, in units of pulses by converting it into the number of steps. In other words, the conveyance control unit 202 can count the number of steps and recognize that the deceleration timing t4 has been reached when the number of steps corresponds to T2a.

Taa and Tda are time periods determined by Vp2, the properties of the conveyance motor 301 (load torque, properties of a motor driver, etc.), and the like. Accordingly, if Vp2 is defined, Taa and Tda are also defined. Note that functions and tables for determining Taa and Tda from Vp2 are stored in advance in the parameter storage unit 205, and the calculation unit 206 thereby calculates them.

Details of Deceleration Control

Next, deceleration control in step S505 will be described, referring to FIGS. 6B, 8B, 9B, and 10. As shown in FIG. 6B, the conveyance control unit 202 executes the deceleration control in step S505 if the actual sheet interval Lac measured using the top sensor 105 is smaller than the ideal value Lid of the sheet interval. According to FIG. 6B, the distance by which the sheet interval need only be extended is Lw. Therefore, the succeeding sheet P2 need only advance by Lf while the preceding sheet P1 advances by the distance Lf+Lw.

For this reason, as shown in FIGS. 8A and 9A, upon the succeeding sheet P2 being detected at the timing t1, the conveyance control unit 202 decelerates the conveyance speed from Vp1 to Vp3. In other words, in step S1001 shown in FIG. 10, the conveyance control unit 202 starts deceleration of the conveyance motor 301. Vp3 is a lower speed than the circumferential speed Vd of the photosensitive drum 122, and may be a predetermined speed, or may be a dynamically determined speed. If the speed is dynamically determined, the speed is determined such that extension of the sheet interval is finished while the succeeding sheet P2 moves from the position of the top sensor 105 to the transfer nip part. In the deceleration control, as in the acceleration control, the conveyance speed may be changed linearly from Vp1 to Vp3, or may be changed non-linearly according to a higher-order function or a discrete function.

In step S1002, the conveyance control unit 202 calculates a sub-scan synchronization signal output timing Ttop3. The conveyance control unit 202 calculates the sub-scan synchronization signal output timing from the distance Lw by which the sheet distance need only be extended, based on the following expression.

$$Ttop3=(Lf-Ld+Lw)/Vd \quad \text{Eq. 15}$$

As is clear from Eq. 15, Ttop3 is delayed by Lw/Vd compared with a normal case, so as to decelerate the succeeding sheet P2. Here, the "normal case" refers to the case where the succeeding sheet P2 is not accelerated or decelerated.

Figure 8B:
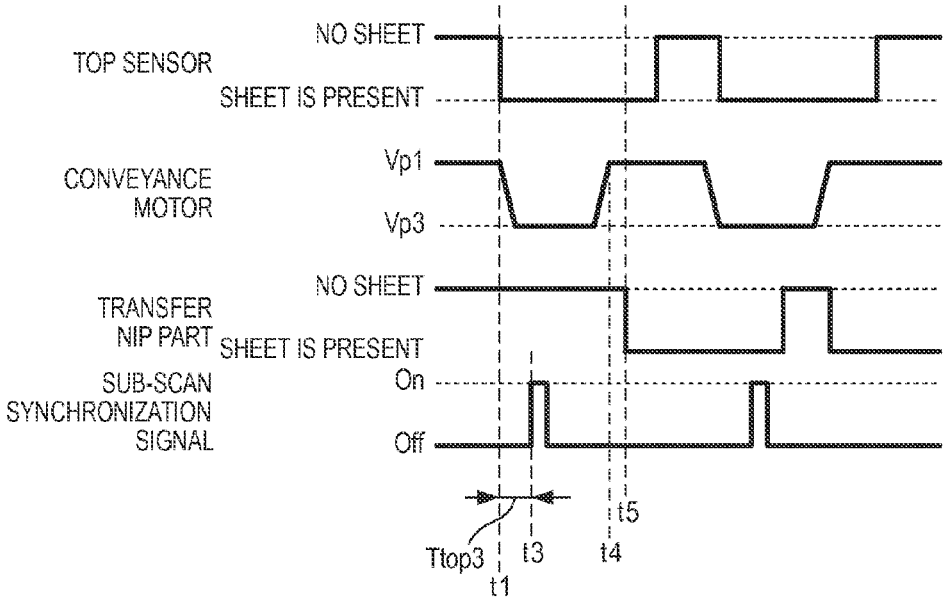
FIG. 8B is a diagram showing signal timings.

In step S1003, the conveyance control unit 202 outputs the sub-scan synchronization signal to the image formation control unit 201 at the timing t3 when Ttop3 has elapsed since the timing t1, as shown in FIG. 8B. Note that at the timing t2 shown in FIG. 9B, the conveyance control unit 202 fixes the conveyance speed to Vp3. Note that a deceleration period Tdb from the timing t1 to the timing t2 is a time period determined based on the properties of the conveyance motor 301. In terms of the temporal relationship, either the timing t2 or the timing t3 may come first.

In step S1004, the conveyance control unit 202 determines whether or not the timing t4 to accelerate the conveyance motor 301 has been reached. After the timing t4 to accelerate the conveyance motor 301 has been reached, processing proceeds to step S1005. In step S1005, the conveyance control unit 202 accelerates the conveyance motor 301 and returns the conveyance speed from Vp3 to Vp1.

Figure 9B:
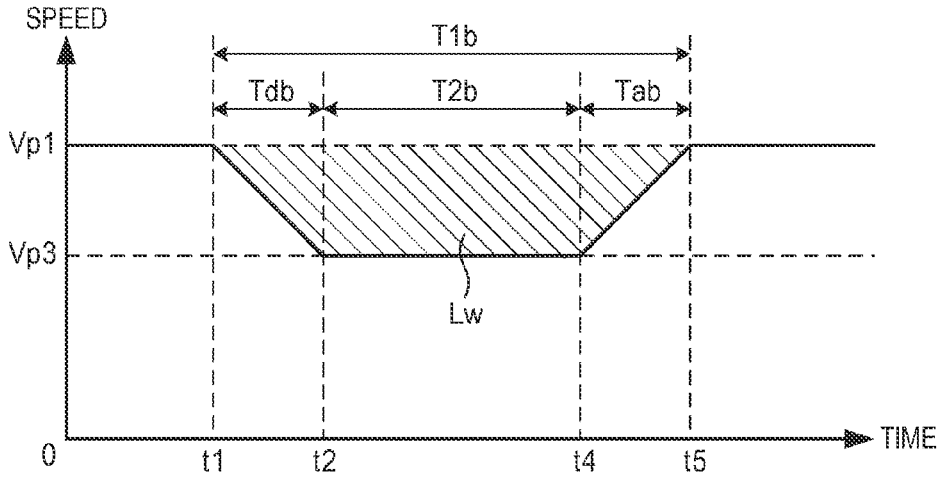
FIG. 9B is a diagram showing a method for finding T2b.
Figure 10:
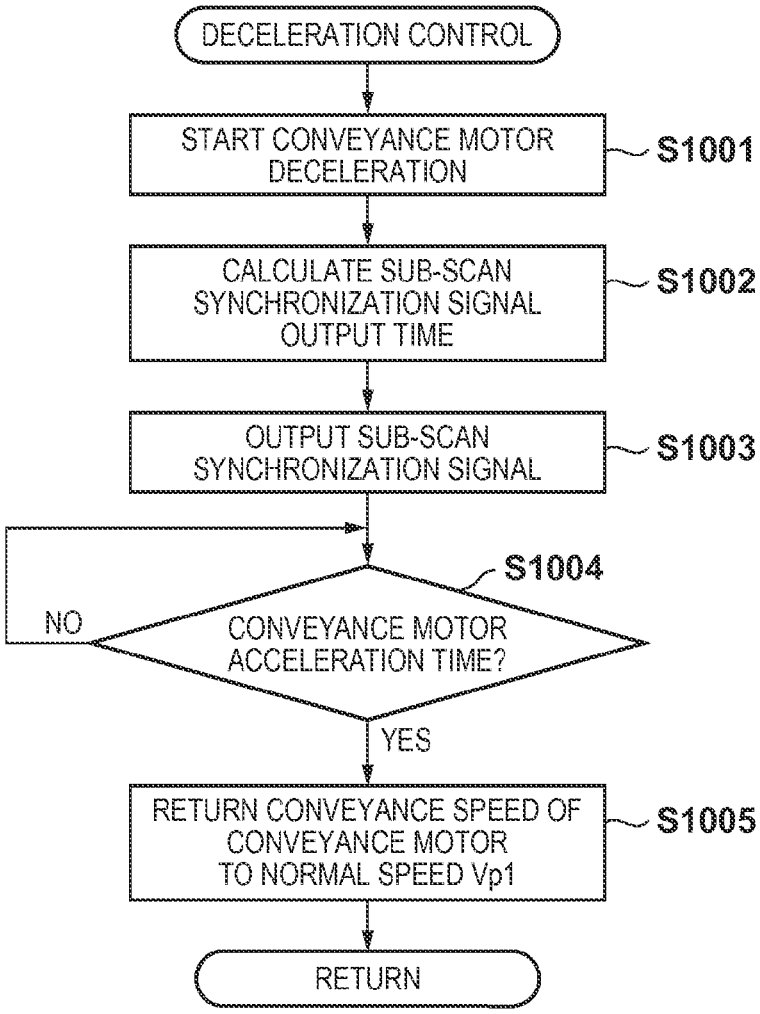
FIG. 10 is a flowchart showing deceleration control.

Here, as shown in FIG. 9B, the acceleration timing t4 is the time when T2b has elapsed since the timing t2. Now, the method for finding T2b will be described. As shown in FIG. 6C, the distance (sheet interval) from the leading edge of the succeeding sheet P2 to the trailing edge of the preceding sheet P1 is required to be the ideal value Lid at the time (timing t5) when the leading edge of the succeeding sheet P2 reaches the transfer nip part. To realize this, as shown in FIGS. 6B and 6C, the leading edge of the succeeding sheet P2 need only advance by the distance Lf while the trailing edge of the preceding sheet P1 advances by the distance (Lf+Lw). In other words, the preceding sheet P1 need only advance further than the succeeding sheet P2 by the distance Lw during the timing T1b shown in FIG. 9B. Here, since the preceding sheet P1 advances at the speed Vp1 by the distance (Lf+Lw) during the timing T1b, the following expression holds.

$$Vp1 \cdot T1b=Lf+Lw \quad \text{Eq. 16}$$

Eq. 17 is obtained by transforming Eq. 16.

$$T1b=(Lf+Lw)/Vp1 \quad \text{Eq. 17}$$

Note that at the timing t1 when the leading edge of the succeeding sheet P2 reaches the top sensor 105, the preceding sheet P1 is already being held by the transfer nip part. Accordingly, the preceding sheet P1 is being conveyed at the conveyance speed Vp1 that is the same as the circumferential speed Vd of the photosensitive drum. From FIG. 6B, the following expression holds.

$$Lw=Lid-Lac \quad \text{Eq. 18}$$

Eq. 18' is obtained by substituting Eq. 18 into Eq. 15.

$$Ttop3=(Lf-Ld+Lid-Lac)/Vd \quad \text{Eq. 18'}$$

Here, Lac is the distance by which the trailing edge of the preceding sheet P1 advances after passing through the top sensor 105 until the leading edge of the succeeding sheet P2 reaching the top sensor 105. The period tac after the trailing edge of the preceding sheet P1 has passed through the top sensor 105 until the leading edge of the succeeding sheet P2 reaches the top sensor 105 can be measured by the counter 203.

Meanwhile, since the preceding sheet P1 is held by the transfer nip part and the conveyance speed of the preceding sheet P1 is Vp1 (=Vd), the following expression is obtained.

$$Lac=tac \cdot Vd \quad \text{Eq. 19}$$

Eq. 20 is obtained by substituting Eq. 19 into Eq. 18' and arranging it.

$$Ttop3=c0-tac \quad \text{Eq. 20}$$

Here, c0 is (Lf−Ld+Lid)/Vd and is a known constant. Thus, Ttop3 is easily found from the constant c0 and tac that is found from the count value of the counter 203 (S1002).

Meanwhile, in FIG. 9B, T1b is a time period after the timing t1 when the leading edge of the succeeding sheet P2 reaches the top sensor 105 to the timing t5 when the leading edge of the succeeding sheet P2 reaches the transfer nip part. The preceding sheet P1 can advance further than the succeeding sheet P2 by the distance Lw by temporarily decelerating the conveyance speed Vp1 to Vp3 during the time period from the timing t1 to the timing t5. In other words, the sheet interval extends by the distance Lw. T2b is found such that the area of the hatched region shown in FIG. 9B is the distance Lw. When the distance Lw is generalized, the following expression is obtained.

$$Lw=Lx1+Lid-\int_{t1}^{t2} v1(t)dt-\int_{t2}^{t4} v2(t)dt-\int_{t4}^{t5} v3(t)dt \quad \text{Eq. 9}$$

Here, v1(t) is the conveyance speed of the succeeding sheet P2 in the section from the timing t1 to the timing t2. v2(t) is the conveyance speed of the succeeding sheet P2 in the section from the timing t2 to the timing t4. v3(t) is the conveyance speed of the succeeding sheet P2 in the section from the timing t4 to the timing t5. Since v1(t) and v3(t) depend on the properties of the conveyance motor 301, they are expressed not only by linear functions but also by higher-order functions such as quadratic functions in some cases. Also, v1(t) and v3(t) may be discrete functions. v1(t) and v3(t) may be, for example, variable and discontinuous values from 1.0 times to 1.5 times of Vp1 (which, however, needs to be changed to a lower speed than Vp1). Note that Vp3 may be zero. If Vp3 is set to zero, the sheet interval can be brought close to the ideal value Lid in a short time. Moreover, the driving sound is minimized because the conveyance motor 301 stops. However, in order to improve the accuracy of the image formation position, the conveyance control unit 202 controls the conveyance speed so as not to completely stop the conveyance motor 301. This is because the leading edge position of the sheet P may possibly vary if conveyance of the sheet P is stopped.

Here, for the sake of convenience of description, it is assumed that both the acceleration rate from Vp1 to Vp3 and the acceleration rate from Vp3 to Vp1 are constant. The area of the hatched portion of FIG. 9B, that is, the distance Lw is calculated from the following expression.

$$Lw=(T1b+T2b)\cdot(Vp1-Vp3)/2 \quad \text{Eq. 22}$$

T2b is found by transforming this, and thus, the following expression is obtained.

$$T2b=2Lw/(Vp1-Vp3)-T1b \quad \text{Eq. 23}$$

Here, the following expression is obtained by substituting Eq. 17 into Eq. 23.

$$T2b=2Lw/(Vp1-Vp3)-(Lf+Lw)/Vp1 \quad \text{Eq. 24}$$

Note that Vp1, Vp3 and Lf are known. Also, Eq. 25 is obtained by substituting Eq. 19 into Eq. 18 and arranging it.

$$Lw=Lid-Vp1 \cdot tac \quad \text{Eq. 25}$$

Accordingly, Lw is defined from Eq. 25 by measuring tac. In other words, if tac can be measured, T2b can be calculated from Eq. 24. Note that Eq. 24 can be expressed as follows using two coefficients γ and ϵ that can be found in advance.

$$T2b=\gamma\cdot tac+\epsilon \quad \text{Eq. 24'}$$

Note that γ is determined from Vp1 and Vp3, and ϵ is determined from Vp1, Vp3, Lid, and Lf.

T2b corresponds to the time period during which processing stays at step S1004. Accordingly, the conveyance control unit 202 can determine whether or not the current time is the acceleration timing t4 by determining whether or not T2b has elapsed since the timing t2 when deceleration of the conveyance motor 301 ended. Note that if the conveyance motor 301 is a pulse motor, the conveyance control unit 202 may manage T2b, which is the time of rotation, in units of pulses by converting it into the number of steps. In other words, the conveyance control unit 202 can count the number of steps and recognize that the acceleration timing t4 has been reached when the number of steps corresponds to T2b.

Tdb and Tab are time periods determined by Vp3, the properties of the conveyance motor 301 (load torque, properties of a motor driver, etc.), and the like. Accordingly, if Vp3 is defined, Tdb and Tab are also defined.

According to the present embodiment, the leading edge position of the sheet P is detected by the top sensor 105 without stopping the sheet P at the registration roller 104, and therefore, variation in the leading edge position caused by the stopping of the sheet P does not occur. In other words, the accuracy of the toner image formation position on the sheet P can be improved. Also, a small sheet interval can be maintained by accelerating or decelerating the succeeding sheet P2 in the conveyance section from the top sensor 105 to the transfer nip part. In other words, the present embodiment does not execute acceleration or deceleration of the succeeding sheet P2 in the conveyance section from the sheet feed roller 102 to the top sensor 105, as in the conventional techniques. For this reason, the conveyance section from the sheet feed roller 102 to the top sensor 105 can be shortened, and accordingly, the size of the image forming apparatus 100 can be reduced. Also, high throughput can be realized by maintaining the small sheet interval.

In particular, according to the present embodiment, if the actual sheet interval Lac is larger than the ideal value Lid, the drive control unit 207 controls the conveyance motor 301 so as to temporarily accelerate the conveyance speed of the succeeding sheet P2 from the first conveyance speed Vp1, which is the sheet conveyance speed Vd at the transfer roller 106, to the second conveyance speed Vp2. Also, if the actual sheet interval Lac is smaller than the ideal value Lid, the drive control unit 207 controls the conveyance motor 301 so as to temporarily decelerate the conveyance speed of the succeeding sheet P2 from the first conveyance speed Vp1 to the third conveyance speed Vp3. Note that if the actual sheet interval Lac coincides with the ideal value Lid, the drive control unit 207 controls the conveyance motor 301 so as to maintain the conveyance speed of the succeeding sheet P2 at the first conveyance speed Vp1.

As described with reference to FIG. 9A regarding the acceleration control, the conveyance period T1a during which the succeeding sheet P2 is conveyed from the top sensor 105 to the transfer roller 106 includes the acceleration period Taa during which the conveyance speed of the succeeding sheet P2 is increased from the first conveyance speed Vp1 to the second conveyance speed Vp2, the maintaining period T2a during which the conveyance speed of the succeeding sheet P2 is maintained at the second conveyance speed Vp2, and the deceleration period Tda during which the conveyance speed of the succeeding sheet P2 is decelerated from the second conveyance speed Vp2 to the first conveyance speed Vp1. The parameter storage unit 205 stores the acceleration period Taa and the deceleration period Tda that are determined at the time of shipping from the factory in accordance with the performance of the conveyance motor 301. Also, the parameter storage unit 205 also stores in advance the multiplier coefficient α and the predetermined constant β. The calculation unit 206 calculates the maintaining period T2a by calculating the time period tac corresponding to the actual sheet interval Lac, multiplying the time period tac by the multiplier coefficient α, and further adding the predetermined constant β thereto. The drive control unit 207 maintains the conveyance speed of the succeeding sheet P2 at the second conveyance speed Vp2 over the maintaining period T2a.

As described with reference to FIG. 9B regarding the deceleration control, the conveyance period T1b during which the succeeding sheet P2 is conveyed from the top sensor 105 to the transfer roller 106 includes a deceleration period Tdb during which the conveyance speed of the succeeding sheet P2 is decelerated from the first conveyance speed Vp1 to the third conveyance speed Vp3, a maintaining period T2b during which the conveyance speed of the succeeding sheet P2 is maintained at the third conveyance speed Vp3, and an acceleration period Tab during which the conveyance speed of the succeeding sheet P2 is accelerated from the third conveyance speed Vp3 to the first conveyance speed Vp1. The deceleration period Tdb and the acceleration period Tab are the time periods determined in accordance with the performance of the conveyance motor 301. The parameter storage unit 205 stores the deceleration period Tdb and the acceleration period Tab, which are determined at the time of shipping from the factory. The parameter storage unit 205 also stores a predetermined constant ϵ and a multiplier coefficient γ, which is determined at the time of shipping from the factory. The calculation unit 206 calculates the maintaining period T2b by calculating the time period tac corresponding to the actual sheet interval Lac, multiplying the time period tac by the multiplier coefficient γ, and further adding the predetermined constant ϵ thereto. In other words, as a result of the sheet interval measurement unit 204 measuring the sheet interval period tac, the calculation unit 206 can determine the maintaining period T2b by applying simple arithmetic operations to the sheet interval period tac. Note that the drive control unit 207 need only control the conveyance motor 301 such that the conveyance speed of the succeeding sheet P2 coincides with the first conveyance speed Vp1 by the time that the leading edge of the succeeding sheet P2 enters the transfer nip part of the transfer roller 106 at the latest. Also, the calculation unit 206 can determine the sub-scan synchronization signal output timing from the sheet interval period tac and the predetermined constant c0 that is found in advance, using Eq.s 8 and 20. The predetermined constant c0 may also be determined at the time of shipping from the factory and stored in the parameter storage unit 205. As described above, according to the present embodiment, the maintaining periods T2a and T2b and the sub-scan synchronization signal output timing can be determined by a simple calculation based on the parameters determined in accordance with the performance of the conveyance motor 301 and the actually-measured sheet interval period tac.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-175411, filed Aug. 7, 2012 which is hereby incorporated by reference herein in its entirety.

What is claimed is:

1. An image forming apparatus comprising:

an image bearing member on which an image is formed;

a transfer unit configured to transfer an image formed on the image bearing member onto a sheet;

a conveyance unit configured to successively convey a first sheet and a second sheet succeeding the first sheet toward the transfer unit;

a detection unit configured to detect a sheet at a predetermined position on an upstream side of the transfer unit in a sheet conveyance direction; and an image forming unit configured to start formation of an image on the image bearing member after a predetermined period from detection by the detection unit of a sheet on which the image is to be transferred, wherein if the detection unit detects a leading edge of the second sheet at a predetermined timing after detecting a trailing edge of the first sheet, the conveyance unit conveys the second sheet at a first conveyance speed, wherein if the detection unit detects the leading edge of the second sheet at a timing later than the predetermined timing after detecting the trailing edge of the first sheet, the conveyance unit switches the conveyance speed to a second conveyance speed, the second conveyance speed being higher than the first conveyance speed, and conveys the second sheet at the second conveyance speed, and wherein the predetermined period in the case where the conveyance unit conveys the second sheet at the second conveyance speed is shorter than the predetermined period in the case where the conveyance unit conveys the second sheet at the first conveyance speed.

2. The image forming apparatus according to claim 1, further comprising:

an accommodation unit configured to accommodate a sheet, wherein the conveyance unit conveys a sheet without stopping from the accommodation unit toward the transfer unit.

3. The image forming apparatus according to claim 1, wherein if the conveyance unit conveys the second sheet at the second conveyance speed, the conveyance unit switches the conveyance speed to the first conveyance speed at least by the time that the leading edge of the second sheet reaches the transfer unit, and conveys the second sheet at the first conveyance speed.

4. The image forming apparatus according to claim 1, wherein the predetermined position is located on a downstream side of the conveyance unit in the sheet conveyance direction.

5. An image forming apparatus comprising:

an image bearing member on which an image is formed;

a transfer unit configured to transfer an image formed on the image bearing member onto a sheet;

a conveyance unit configured to successively convey a first sheet and a second sheet toward the transfer unit;

a detection unit configured to detect a sheet at a predetermined position on an upstream side of the transfer unit in a sheet conveyance direction; and an image forming unit configured to start formation of an image on the image bearing member after a predetermined period from detection by the detection unit of a sheet on which the image is to be transferred, wherein if the detection unit detects a leading edge of the second sheet at a predetermined timing after detecting a trailing edge of the first sheet, the conveyance unit conveys the second sheet at a first conveyance speed, wherein if the detection unit detects the leading edge of the second sheet at a timing earlier than the predetermined timing after detecting the trailing edge of the first sheet, the conveyance unit switches the conveyance speed to a second conveyance speed, the second conveyance speed being lower than the first conveyance speed, and conveys the second sheet at the second conveyance speed, and wherein the predetermined period in the case where the conveyance unit conveys the second sheet at the second conveyance speed is longer than the predetermined period in the case where the conveyance unit conveys the second sheet at the first conveyance speed.

6. The image forming apparatus according to claim 5, further comprising:

an accommodation unit configured to accommodate a sheet, wherein the conveyance unit conveys a sheet without stopping from the accommodation unit toward the transfer unit.

7. The image forming apparatus according to claim 5, wherein if the conveyance unit conveys the second sheet at the second conveyance speed, the conveyance unit switches the conveyance speed to the first conveyance speed at least by the time that the leading edge of the second sheet reaches the transfer unit, and conveys the second sheet at the first conveyance speed.

8. The image forming apparatus according to claim 5, wherein the predetermined position is located on a downstream side of the conveyance unit in the sheet conveyance direction.

9. An image forming apparatus comprising:

an image bearing member on which an image is formed;

a transfer unit configured to transfer an image formed on the image bearing member onto a sheet;

a conveyance unit configured to convey a sheet toward the transfer unit;

a detection unit configured to detect a sheet at a predetermined position on an upstream side of the transfer unit in a sheet conveyance direction;

an image forming unit configured to start formation of an image on the image bearing member after a predetermined period from detection by the detection unit of a sheet on which the image is to be transferred, wherein if the detection unit detects a sheet at a timing later than a predetermined timing, the conveyance unit conveys the sheet at a second conveyance speed that is higher than a first conveyance speed, the first conveyance speed being a conveyance speed at the time when an image is transferred onto a sheet, and wherein the image forming unit shortens the predetermined period in accordance with the timing of detection of the sheet by the detection unit.

10. An image forming apparatus comprising:

an image bearing member on which an image is formed;

a transfer unit configured to transfer an image formed on the image bearing member onto a sheet;

a conveyance unit configured to convey a sheet toward the transfer unit;

a detection unit configured to detect a sheet at a predetermined position on an upstream side of the transfer unit in a sheet conveyance direction;

an image forming unit configured to start formation of an image on the image bearing member after a predetermined period from detection by the detection unit of a sheet on which the image is to be transferred, wherein if the detection unit detects a sheet at a timing earlier than a predetermined timing, the conveyance unit conveys the sheet at a second conveyance speed that is lower than a first conveyance speed, the first conveyance speed being a conveyance speed at the time when an image is transferred onto a sheet, and wherein the image forming unit extends the predetermined period in accordance with the timing of detection of the sheet by the detection unit.

11. The image forming apparatus according to claim 1, wherein the image forming unit includes an irradiating unit configured to irradiate the image bearing member with light, and the irradiating unit is further configured to start irradiating the image bearing member after a predetermined period from detection by the detection unit of a sheet on which the image is to be transferred.

12. The image forming apparatus according to claim 1, wherein if the detection unit detects the leading edge of the second sheet at a timing later than the predetermined timing after detecting the trailing edge of the first sheet, the conveyance unit determines the second conveyance speed based on a difference between the predetermined timing and the timing at which the detection unit detects the leading edge of the second sheet.

13. The image forming apparatus according to claim 1, wherein if the detection unit detects the leading edge of the second sheet at a timing later than the predetermined timing after detecting the trailing edge of the first sheet, the image forming unit shortens the predetermined period based on a difference between the predetermined timing and the timing at which the detection unit detects the leading edge of the second sheet.

14. The image forming apparatus according to claim 1, wherein the first conveyance speed is a conveyance speed at the time when an image is transferred onto a sheet.

15. The image forming apparatus according to claim 5, wherein the image forming unit includes an irradiating unit configured to irradiate the image bearing member with light, and the irradiating unit is further configured to start irradiating the image bearing member after a predetermined period from detection by the detection unit of a sheet on which the image is to be transferred.

16. The image forming apparatus according to claim 5, wherein if the detection unit detects the leading edge of the second sheet at a timing earlier than the predetermined timing after detecting the trailing edge of the first sheet, the conveyance unit determines the second conveyance speed based on a difference between the predetermined timing and the timing at which the detection unit detects the leading edge of the second sheet.

17. The image forming apparatus according to claim 5, wherein if the detection unit detects the leading edge of the second sheet at a timing earlier than the predetermined timing after detecting the trailing edge of the first sheet, the image forming unit extends the predetermined period based on a difference between the predetermined timing and the timing at which the detection unit detects the leading edge of the second sheet.

18. The image forming apparatus according to claim 5, wherein the first conveyance speed is a conveyance speed at the time when an image is transferred onto a sheet.

19. An image forming apparatus comprising:

an image forming unit including an image bearing member configured to form an image on the image bearing member;

a control unit configured to control the image forming unit;

a transfer unit configured to transfer an image formed on the image bearing member onto a sheet;

a conveyance unit configured to convey a sheet toward the transfer unit; and a detection unit configured to detect a sheet at a predetermined position on an upstream side of the transfer unit in a sheet conveyance direction, wherein the image forming unit is further configured to start formation of an image on the image bearing member after detection by the detection unit of a sheet on which the image is to be transferred, wherein if the detection unit detects a sheet at a timing later than a predetermined timing, the conveyance unit conveys the sheet at a second conveyance speed that is higher than a first conveyance speed, the first conveyance speed being a conveyance speed at the time when an image is transferred onto a sheet, and wherein the control unit is further configured to control the image forming unit in accordance with the timing of detection of the sheet by the detection unit such that the image formed on the image bearing member is transferred onto the sheet by the transfer unit.

20. The image forming apparatus according to claim 19, wherein the conveyance unit is configured to successively convey a first sheet and a second sheet succeeding the first sheet toward the transfer unit, wherein if the detection unit detects a leading edge of the second sheet at a timing later than the predetermined timing after detecting the trailing edge of the first sheet, the conveyance unit conveys the second sheet at the second conveyance speed, and wherein the control unit is further configured to control the image forming unit in accordance with the timing of detection of the leading edge of the second sheet by the detection unit such that the image formed on the image bearing member is transferred onto the second sheet by the transfer unit.

21. The image forming apparatus according to claim 20, wherein the conveyance unit is further configured to convey the second sheet at the second conveyance speed such that an interval between the trailing edge of the first sheet and the leading edge of the second sheet becomes a predetermined interval.

22. The image forming apparatus according to claim 20, wherein if the conveyance unit conveys the second sheet at the second conveyance speed, the conveyance unit switches the conveyance speed to the first conveyance speed at least by the time that the leading edge of the second sheet reaches the transfer unit, and conveys the second sheet at the first conveyance speed.

23. An image forming apparatus comprising:

an image forming unit including an image bearing member configured to form an image on the image bearing member;

an control unit configured to control the image forming unit;

a transfer unit configured to transfer an image formed on the image bearing member onto a sheet;

a conveyance unit configured to convey a sheet toward the transfer unit; and a detection unit configured to detect a sheet at a predetermined position on an upstream side of the transfer unit in a sheet conveyance direction, wherein the image forming unit is further configured to start formation of an image on the image bearing member after detection by the detection unit of a sheet on which the image is to be transferred, wherein if the detection unit detects a sheet at a timing earlier than a predetermined timing, the conveyance unit conveys the sheet at a second conveyance speed that is lower than a first conveyance speed, the first conveyance speed being a conveyance speed at the time when an image is transferred onto a sheet, and wherein the control unit is further configured to control the image forming unit in accordance with the timing of detection of the sheet by the detection unit such that the image formed on the image bearing member is transferred onto the sheet by the transfer unit.

24. The image forming apparatus according to claim 23, wherein the conveyance unit is configured to successively convey a first sheet and a second sheet succeeding the first sheet toward the transfer unit, wherein if the detection unit detects a leading edge of the second sheet at a timing earlier than the predetermined timing after detecting the trailing edge of the first sheet, the conveyance unit conveys the second sheet at the second conveyance speed, and wherein the control unit is further configured to control the image forming unit in accordance with the timing of detection of the leading edge of the second sheet by the detection unit such that the image formed on the image bearing member is transferred onto the second sheet by the transfer unit.

25. The image forming apparatus according to claim 24, wherein the conveyance unit is further configured to convey the second sheet at the second conveyance speed such that an interval between the trailing edge of the first sheet and the leading edge of the second sheet becomes a predetermined interval.

26. The image forming apparatus according to claim 24, wherein if the conveyance unit conveys the second sheet at the second conveyance speed, the conveyance unit switches the conveyance speed to the first conveyance speed at least by the time that the leading edge of the second sheet reaches the transfer unit, and conveys the second sheet at the first conveyance speed.

* * * * *